US008267717B2

(12) United States Patent
Ishishita et al.

(10) Patent No.: US 8,267,717 B2
(45) Date of Patent: Sep. 18, 2012

(54) FPC CONNECTOR HAVING ROTATING ACTUATOR

(75) Inventors: Takahisa Ishishita, Saitama-ken (JP); Eri Fujiwara, Osaka (JP)

(73) Assignee: FCI, Versailles (FR)

( * ) Notice: Subject to any disclaimer, the term of this patent is extended or adjusted under 35 U.S.C. 154(b) by 139 days.

(21) Appl. No.: 12/734,799

(22) PCT Filed: Nov. 27, 2008

(86) PCT No.: PCT/IB2008/055654

§ 371 (c)(1),
(2), (4) Date: May 25, 2010

(87) PCT Pub. No.: WO2009/069108

PCT Pub. Date: Jun. 4, 2009

(65) Prior Publication Data

US 2010/0304591 A1 Dec. 2, 2010

(30) Foreign Application Priority Data

Nov. 29, 2007 (WO) ..... PCT/IB2007/055395

(51) Int. Cl.
*H01R 12/24* (2006.01)

(52) U.S. Cl. ..... 439/495; 439/260

(58) Field of Classification Search ..... 439/495, 439/260, 67, 329

See application file for complete search history.

(56) References Cited

U.S. PATENT DOCUMENTS

| | | | | |
|---|---|---|---|---|
| 6,893,278 | B2 | 5/2005 | Ohsawa | 439/260 |
| 7,128,597 | B2 * | 10/2006 | Niitsu et al. | 439/495 |
| 7,134,891 | B2 * | 11/2006 | Kayama et al. | 439/260 |
| 7,179,118 | B1 * | 2/2007 | Harlan et al. | 439/495 |
| 7,473,125 | B2 * | 1/2009 | Murakami | 439/495 |
| 7,909,639 | B2 * | 3/2011 | Hirata et al. | 439/495 |
| 7,946,872 | B2 * | 5/2011 | Taketomi et al. | 439/260 |
| 2002/0106924 | A1 | 8/2002 | Uehara | 439/260 |

FOREIGN PATENT DOCUMENTS

| | | |
|---|---|---|
| JP | 2003-208946 | 7/2003 |
| JP | 2004-111141 | 4/2004 |
| JP | 3722534 B2 | 11/2005 |

* cited by examiner

*Primary Examiner* — Hien Vu
(74) *Attorney, Agent, or Firm* — Harrington & Smith

(57) ABSTRACT

An FPC connector has a main body and an actuator movably attached thereto. When at an opened position, the actuator and the main body form a space therebetween into which an FPC can be inserted. The actuator can then be rotated towards the main body to close the space, such that the FPC is sandwiched and hold between the main body and the actuator. The actuator has a pair of pivots which are received by a pair of slots formed by the pair of support plates fixed to the main body. The actuator has a pair of latches which, when the actuator rotates to the locked position, act against a lock portion of the support plates and cause the lock portions to deform resiliently outwardly. When the latches pass over the lock portions, the lock portions resumes to the original position and lock the latches.

6 Claims, 5 Drawing Sheets

FPC CONNECTOR HAVING ROTATING ACTUATOR

TECHNICAL FIELD

The present invention relates to an electrical connector, in particular, to a electrical connector for electrically connecting to a flexible printed circuit (FPC) and the like.

BACKGROUND ART

Recently, there is a need to decrease the size of connectors which make electrical connections and increase the density of electrodes in the connectors. In particular, there is a strong need to reduce the physical dimension and increase the connection density of the connector, due to the decrease in size and increase in density of modern electronic devices. Moreover, there is a need to connect FPC to a connector with simplified operations.

Conventional FPC connectors are complicated in structure which makes it difficult to reduce the size of the connector and require more operation steps to connect to FPC. It is therefore a need to provide an electrical connector which is compact in size and capable of connecting to an FPC with simplified operation steps.

SUMMARY OF THE INVENTION

Embodiments of the present invention provide an electrical connector for connecting to a flexible printed circuit (FPC). The connector has a main body and an actuator movably attached to the main body. When the actuator is at an opened position, the actuator and the main body form a space therebetween, and an end portion of an FPC can be inserted into the space. The actuator can then be rotated towards the main body to close the space, such that the FPC is sandwiched and hold between the main body and the actuator. The actuator has a pair of pivots which are received by a pair of slots formed by the pair of support plates fixed to the main body. The actuator also has a pair of latches which, when the actuator rotates to the locked position, act against a lock portion of the support plates and cause the lock portions to deform resiliently outwardly. When the latches pass over the lock portions, the lock portions resumes to the original position. The latches can be engaged with the lock portions, hence the actuator is locked to the main body.

When the FPC is to be disconnected from the connector, the actuator can slide towards the front end of the main body. This will cause the latches to move beyond the end of the pock portions, and the actuator can be unlocked from the main body, and opened to allow retrieval and/or replacement of the FPC.

Embodiments of the present invention achieve effective operation to attach an FPC to a connector without increasing the number of parts of the connector. Locking of the actuator can be accomplished by a one-step rotation operation of the actuator.

For a better understanding of the present invention and its purpose and preferred embodiments, further description accompanied by figures are provided in detail below.

BEST MODE FOR CARRYING OUT THE INVENTION

Figure 1:
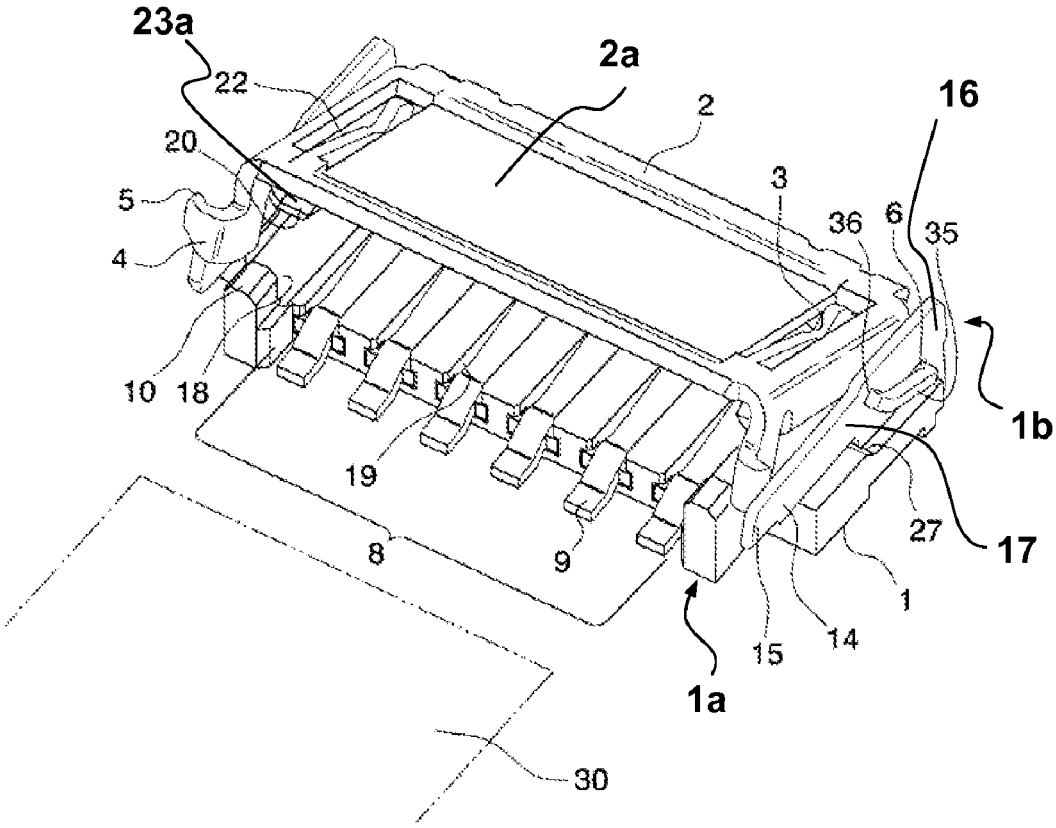
FIG. 1 is a perspective view of a connector according to a first embodiment of the present invention with its actuator at an open position.

FIGS. 1 to 5 show a connector according to a first embodiment of the present invention. As shown in FIG. 1, a connector for attaching to an end portion of an FPC 30 includes a main body 1 made of a formed resin, a metal actuator 2 which can be attached to and removed from main body 1. Main body 1 has a front end 1*a* and a back end 1*b*. A pair of support plates 14 are mounted at both sides of main body 1 Each support plate has a lock portion 15.

As shown in FIG. 1, main body 1 has a support surface 18 for receiving a portion of FPC 30. On support surface 18, terminal grooves 19 are formed into which a plurality of terminals 9 constituting an electrode 8 are disposed. The terminals 9 protrude slightly outwardly from the terminal grooves 19 so as to make electrical connections with FPC 30.

A stop projection 10 is provided on support surface 18 and positions FPC 30 in the surface direction by being inserted into a notch 32 provided on FPC 30. Alternatively, positioning projections may be formed on FPC 30, and recesses for receiving the positioning projections may be formed on support surface 18 (not shown).

An oblique surface 27 is formed at both sides of support surface 18. Oblique surface 27 is formed such that a distal end portion adjacent to back end 1*b* of main body 1 is low and a proximal end portion adjacent to front end 1*a* of main body 1 is high, with a predetermined inclination surface therebetween.

Each support plate 14 has a projection or lock portion 15 at a first end, e.g. projecting towards front end 1*a* of main body 1. Each support plate 14 has a support portion 16 at adjacent to back end 1*b* of main body 1, and a mid portion 17 between lock portion 15 and support portion 16. In the present embodiment, mid portion 17 is fixed to main body 1. Support portion 16 and main body 1 together form a roughly elongated opening or slot 13.

Actuator 2 is generally of a plate shape which has a base portion 2*a* that overlaps with the portion of FPC 30 of a predetermined length. Base portion 2*a* may have a protrusion or boss 3 which projects in the thickness direction of actuator 2. A coating layer (not shown) made of an insulating resin may be formed on the surface of the actuator 2 that fully or partially covers protrusion 3 and that contacts FPC 30.

At both sides in the width direction of actuator 2 there are a pair of holding portions 20 extending from the thickness direction of base portion 2*a*. Holding portions 20 and base portion 2*a* form a pocket 23*a* for receiving FPC 30 therein. Base portion 2*a* has one or a pair of beams 22, each beam 22 has one end connected to base portion 2*a* and another end projecting partially into pocket 23*a*. When an FPC is inserted into pocket 23*a*, beam 22 is biased by the FPC and deforms away from pocket 23*a*. A resume resilient force of beam 22 acts against and holds FPC 30 in pocket 23*a*.

Actuator 2 has a lock arm 4 at each side, which extends in the width direction of the actuator 2. A latch 5, projects outwardly from the distal end of each lock arm 4.

Actuator 2 has a pair of pivots 6, each extends outwardly from base portion 2*a*. Actuator 2 is joined to main body 1, with the pair of pivots 6 received by the pair of slots 13, such that actuator 1 is rotatable relative to main body 1 about pivots 6.

Additionally, each pivot 6 has an extension arm 35 extending radially from pivot 6. The distal end portion of extension arm portion 35 may have an oblique portion 36.

Figure 2:
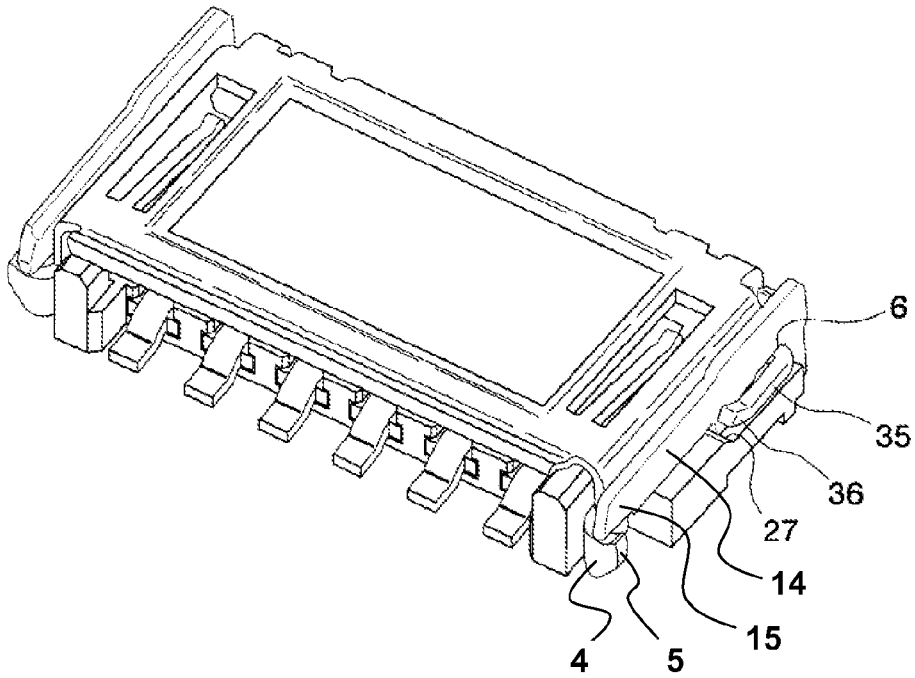
FIG. 2 is a perspective view of FIG. 1 when the actuator is at a locked position.
Figure 3:
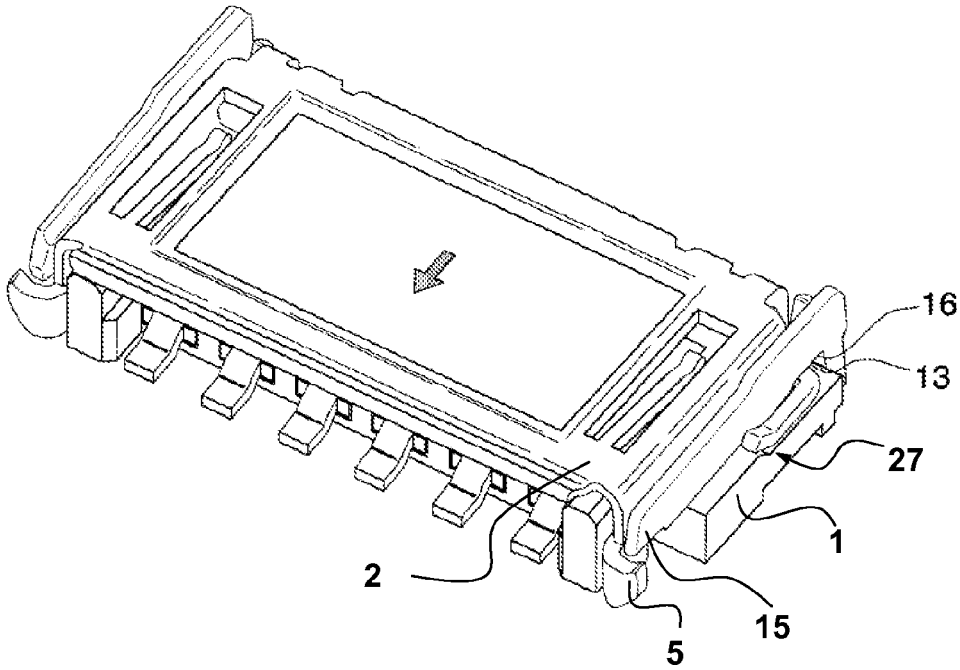
FIG. 3 is a perspective view of FIG. 1 when the actuator is unlocked from the main body.

As shown in FIG. 2, while in a locked position, actuator 2 is locked to main body 1 by the engagement between latch 5 of actuator 2 and lock portion 15 of support plate 14. The electrical connector may be assembled with actuator 2 in the locked position, which is ready to be shipped for assembly with an FPC.

When the connector is to be connected to an FPC, actuator 2 slides toward front end 1*a* of main body 1 (direction of the arrow in FIG. 3), causing latch 5 to move beyond the end portion of, and becomes disengaged from, lock portion 15 of support plate 14. Actuator 2 is now unlocked from main body 1 and moved to a released position. Thereafter, oblique portion 36 is brought into contact with the lower end of oblique surface 27. When actuator 2 slides further in the same direction, oblique portion 36 climbs along oblique surface 27, and extension arm 35 simultaneously rotates clockwise. With the rotation of extension arm 35, actuator 2 rotates in the opening direction around the rotating pivot 6, and is lifted up from main body 1, forming a space therebetween for receiving an FPC.

While actuator 2 is in the opened position, pocket 23*a* becomes accessible. FPC 30 can be inserted into pocket 23*a*, and be pressed by beam 22 of the actuator 2. As a result, FPC 30 can be held by actuator 2 while actuator 2 is at the opened position.

Slot 13 is of an elongated shape which, when actuator 2 is at the open state, allows pivot 6 to slide back towards back end 1*b* of main body 1.

Figure 4:
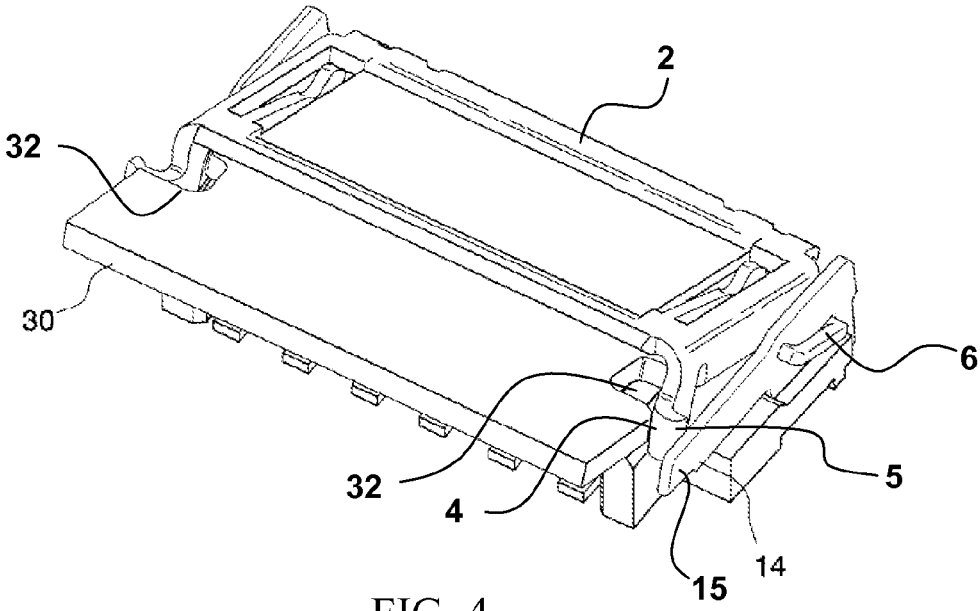
FIG. 4 is a perspective view of FIG. 1 showing an FPC being inserted between the actuator and main body.
Figure 5:
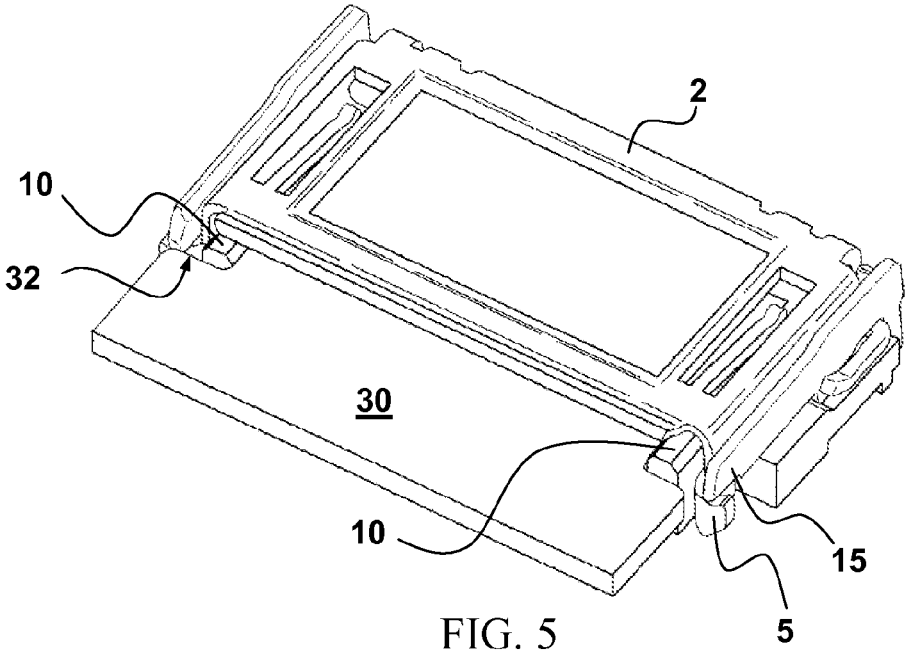
FIG. 5 is a perspective view of FIG. 1 when the actuator is at the locked position and has the FPC connected to the connector.

Thereafter, the actuator 2 can be closed by rotating about pivot 6 along the counter clockwise direction. While actuator 2 rotates, as shown in FIG. 4, latch 5 is brought into contact with lock portion 15. With actuator 2 further rotated, latch 5 resiliently deforms lock portion 15 outwardly from its original, un-deformed position, and pass over lock portion 15. When actuator 2 is completely closed, as shown in FIG. 5, an electrical connection is established by FPC 30 being held between the actuator 2 and the support surface 18. At the same time, the resiliently deformed support plate 14 resumes to its original position, causing latch 5 to become engaged with lock portion 15.

In the present embodiment, actuator 2 can rotate from the opened position, at which FPC 30 is inserted into pocket 23*a*, directly to the locked position, at which FPC 30 is sandwiched between actuator 2 and main body 1 and is electrically connected to the connector. An FPC is mechanically attached and electrically connected to a connector in a simplified operation process. In addition, as the FPC can be held to the actuator before the actuator is closed, it is less possible that the FPC will be detached from the connector during the locking operation of the actuator. Attachment operation and reliability of connecting the FPC to the connector is further improved.

Notch 32 formed on FPC 30 engages with stop projection 10 provided on support surface 18. As a result, FPC 30 is correctly positioned with respect to support surface 18 and is prevented from being pulled out in the longitudinal direction of main body 1.

Stop projection 10 has an additional function of detecting a poor insertion state of FPC 30. If not properly inserted into the connector, FPC 30 will ride on the stop projection 10, and the actuator 2 will therefore not be able to close. A poor insertion situation of an FPC can be detected.

Figure 6:
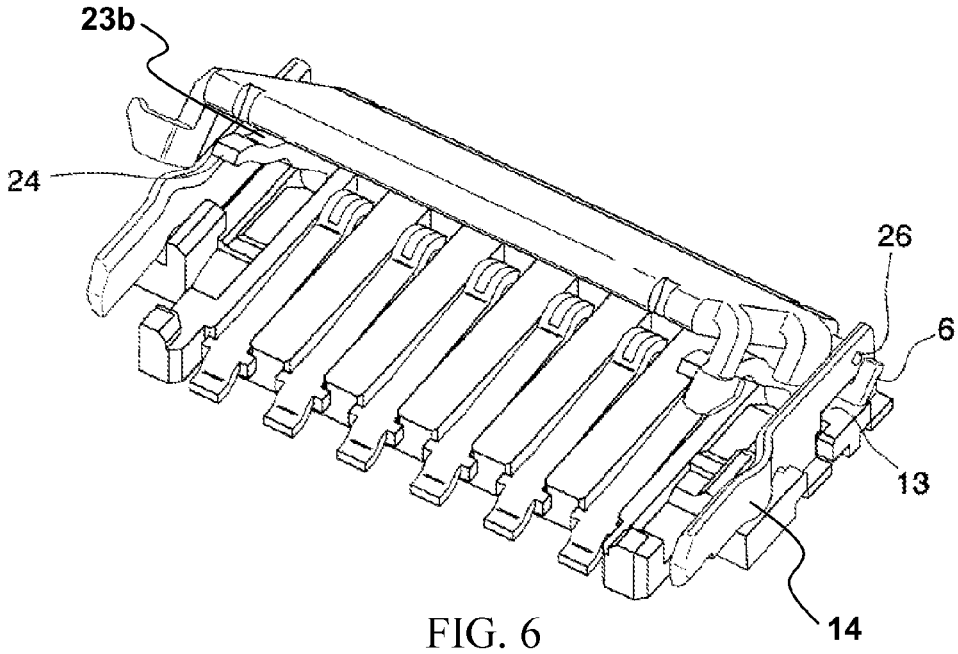
FIG. 6 is a perspective view showing a connector according to a second embodiment of the present invention.
Figure 7:
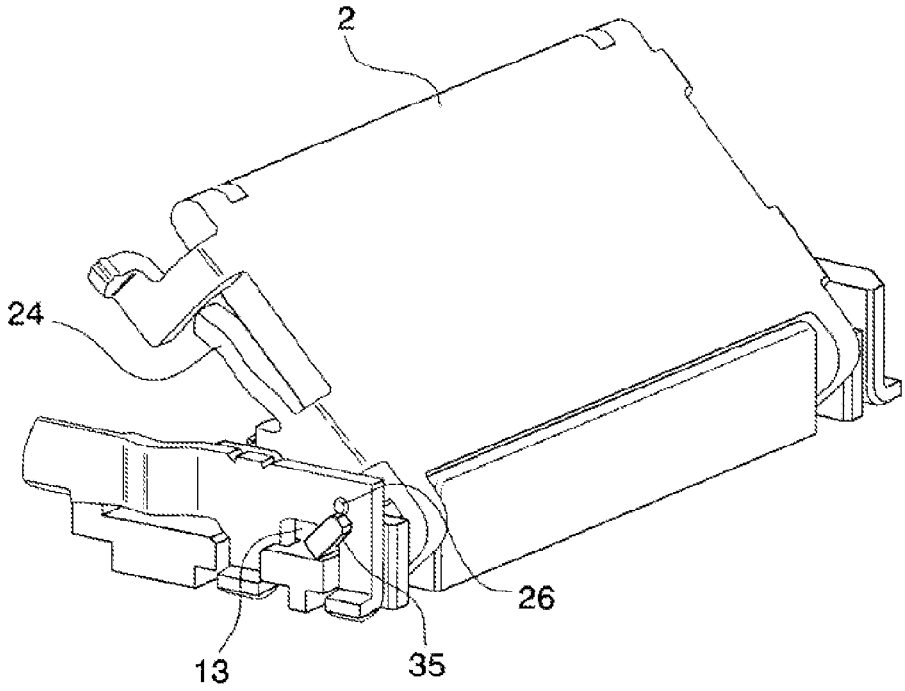
FIG. 7 is a perspective rear view of FIG. 6.
Figure 8:
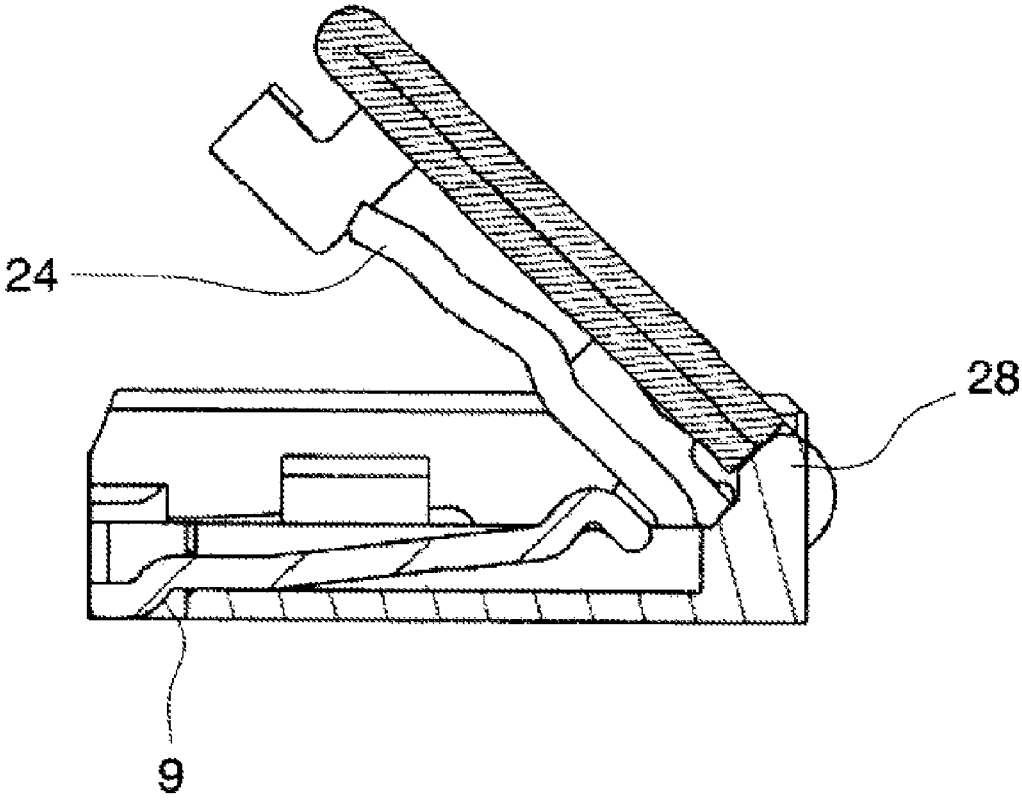
FIG. 8 is a cross sectional side view of FIG. 6.

FIGS. 6 to 8 show a second embodiment of the present invention. In the second embodiment, the same reference symbols are appended to constitutions common to the first embodiment, and an explanation thereof is omitted.

In the second embodiment, actuator 2 has holding portions 24 which, together with base portion 2*a*, form a pocket 23*b* for receiving FPC 30 therein. Holding portion 24 is in the form of a cantilevered spring beam and when an FPC is inserted into pocket 23*b*, holding portion 24 is resiliently deformed which counteracts on the FPC and hence holds FPC in pocket 23*b*.

Additionally, each support plate 14 has a projection 26 for maintaining actuator 2 at the open position, by engaging with extension arm 35. Alternatively, projection 26 may be provided on extension arm 35, and a recess or hole (not shown) for engaging with the projection 26 of the arm portion 35 may be formed on support plate 14.

When an FPC is to be connected to the connector, actuator 2 is rotated to the open position by the same procedure as that of the first embodiment Extension arm 35 engages with projection 26, and actuator 2 is maintained in the opened position.

An end portion of the FPC is inserted into pocket 23*b* and held to actuator 2 by the holding portion 24 and base portion of actuator 2.

The operation of closing the actuator 2 is the same as that of the first embodiment described above, and due to the rotation of actuator 2 to the locked position, FPC 30 is firmed attached and electrically connected to the connector.

A stopping portion 28 may be formed on support surface 18. When actuator 2 rotates towards the open state, stopping portion will block actuator 2, therefore rotation of actuator 2 is restricted within a predetermined range.

The invention claimed is:

1. An electrical connector comprising:

a main body;

a pair of support plates fixed to the main body, each support plate having a lock portion;

an actuator having:

a base portion;

a pair of latches and a pair of pivots extending laterally outwardly from the actuator;

the actuator being movably attached to the main body with the pivots engaging the support plates, wherein the actuator is movable relative to the main body between a first position at which a space is formed between the main body and the actuator for receiving an FPC therein, and a second position at which the space is closed such that the FPC is sandwiched between the main body and the actuator and electrically connected to the body connector, wherein when the actuator moves towards the second position, the lock portions are deflected outwardly by the pair of latches from an original position to allow the latches to pass over and thereafter, the lock portions are resumed to the original position to engage the latches to lock the actuator at the second position, wherein the support plates and the main body form a pair of slots within which the pivots are slidably received such that the actuator is slidable relative to the main body from the second position to a third position at which the pair of latches pass beyond an end of the lock portions of the support plates and become disengaged from the lock portions to allow the actuator to move to the first position, and wherein the main body has a pair of inclined surfaces and the actuator has a pair of extension arms each extending perpendicularly from an end of a corresponding pivot, wherein when the actuator moves beyond the second position, the pair of extension arms urge against the pair of inclined surfaces to cause the actuator to move toward the first position.

2. The electrical connector of claim 1, wherein each of the pair of support plates has a projection and wherein when the actuator moves to the first position, the extension arms are deflected outwardly by and pass over the projections such that the actuator is held at the first position.

3. The electrical connector of claim 1, wherein the actuator has a pair of holding portions extending from the base portion in a thickness direction, wherein the holding portions and the base portion form a pocket therebetween for receiving the FPC therein.

4. The electrical connector of claim 3, wherein the base portion has a pair of resilient beams projecting into the pocket and wherein when an FPC is inserted into the pocket the resilient beams hold the FPC in the pocket.

5. The electrical connector of claim 3, wherein each holding portion has a resilient beam and wherein when an FPC is inserted into the pocket the resilient beams hold the FPC in the pocket.

6. The electrical connector of claim 1, wherein the main body further comprising a stopper at a back end thereof for preventing the actuator from moving beyond the first position.

* * * * *